US005571250A

United States Patent [19]

Stegmaier

[11] Patent Number: 5,571,250

[45] Date of Patent: Nov. 5, 1996

[54] CUTTING BLADE MOUNTING ARRANGEMENT FOR INSERTED BLADE CUTTING HEADS

[75] Inventor: Bernd Stegmaier, Ellenberg, Germany

[73] Assignee: Hapro Hartmetall-Profiltechnik GmbH, Haselbach, Germany

[21] Appl. No.: 507,993

[22] Filed: Jul. 27, 1995

[30] Foreign Application Priority Data

Sep. 3, 1994 [DE] Germany ..... 9414327 U

[51] Int. Cl.[6] ..... B27G 13/00

[52] U.S. Cl. ..... 144/218; 144/230; 144/241; 407/37; 407/113; 83/698.61

[58] Field of Search ..... 83/698.41, 698.61; 144/218, 229, 230, 241; 407/37, 47, 48, 113

[56] References Cited

U.S. PATENT DOCUMENTS

| | | | |
|---|---|---|---|
| 2,521,868 | 9/1950 | Otto | 144/230 |
| 2,814,320 | 11/1957 | Dukes et al. | 144/230 |
| 3,134,412 | 5/1964 | Schmitt | 144/230 |
| 3,600,816 | 8/1971 | Watanabe | 83/698.61 |
| 3,785,417 | 1/1974 | Vora | 144/230 |
| 3,854,511 | 12/1974 | Maier | 144/230 |
| 3,989,077 | 11/1976 | Humbert | 144/230 |
| 4,700,481 | 10/1987 | Barrett | 83/698.61 |
| 5,398,739 | 3/1995 | Everts et al. | 407/113 |
| 5,456,300 | 10/1995 | Rosenkranz et al. | 144/230 |

*Primary Examiner*—W. Donald Bray
*Attorney, Agent, or Firm*—Klaus J. Bach

[57] ABSTRACT

In a cutting blade mounting arrangement for inserted blade cutting heads a mounting plate for supporting a cutting blade at one side thereof has at its opposite side a tooth structure for firm engagement with the cutting head and the cutting blade has ground bores receiving cylindrical fitting pins projecting from the one side of the support plate for accurately positioning the cutting blade on the support plate in axial as well as in radial direction with respect to the axis of the cutting head.

10 Claims, 2 Drawing Sheets

CUTTING BLADE MOUNTING ARRANGEMENT FOR INSERTED BLADE CUTTING HEADS

BACKGROUND OF THE INVENTION

Inserted blade cutting heads or routers are rotating cutting tools used particularly in wood working, for example, for the cutting of wood profiles which consist of a rotatable tool support body and a plurality of cutting blades mounted thereon circumferentially and evenly spaced from one another. The cutting edges of these cutting blades are ground corresponding to the contour of the profile to be cut.

It is important for such cutting heads with inserted blades that the cutting blades of the cutting head are all accurately positioned in axial as well as in radial directions so that all the cutting blades provide for the same cut. The accurate mounting of the various cutting blades must therefore be reproducible in a reliable manner.

Usually, such cutting heads have cutting blade mounting arrangements with a support plate which is provided with a rear gear tooth arrangement and on which the cutting blades abut with their back side. With its rear gear tooth arrangement, the support plate engages a corresponding gear tooth arrangement in the blade carrying cutting head. A chucking wedge is provided which firmly engages the cutting blades with the support plate. The support plate often has at its underside a ground step structure or, in place of the step structure, a ground wedge which is provided in order to form a highly accurate back support surface for the lower edge of the cutting blade.

Pins, inserted into the support plate, which cooperate with a side edge surface of the cutting blade or a lower cut out formed therein to provide a stop structure assuring a predetermined and reproducible axial position for the cutting blade in the cutting head.

It is the object of the present invention to provide an improved cutting blade support arrangement for a cutting head whereby handling of the cutting blades is facilitated and utilization of the cutting blades is improved.

SUMMARY OF THE INVENTION

In a cutting blade mounting arrangement for inserted blade cutting heads a mounting plate for supporting a cutting blade at one side thereof has at its opposite side a tooth structure for firm engagement with the cutting head and the cutting blade has ground bores receiving cylindrical fitting pins projecting from the one side of the support plate for accurately positioning the cutting blade on the support plate in axial as well as in radial direction with respect to the axis of the cutting head.

Preferably, the cutting blade support arrangement according to the invention includes two hardened cylindrical. pins for the accurate relative positioning and support of the support plate and the cutting blade which pins are firmly mounted into the support plate and project into ground bores in the cutting blade. The two cylindrical pins are preferably arranged on a line which extends parallel to the gear structure formed on the rear of the support plate. With this arrangement, a very high positioning accuracy is obtained, that is, the hard metal cutting blade and the support plate are positioned within a tolerance range of at most ±0.01 mm and are radially fixed. Since the hard metal cutting blade cannot be bored, this kind of interlocking of the cutting blade and the support plate is novel as it apparently had never even been taken into consideration that such a solution is possible.

The arrangement according to the invention has a number of advantages: With present positioning arrangements, axial arid side supports had to be provided by separate surface parts at the cutting blade and support plate projections and there was always some play in radial as well as in axial direction between the cutting blade and the support plate stops. Consequently, with prior art cutting blade support arrangements, upon clamping of the cutting blade, the cutting blade had to be firmly held in engagement with the shops on the support plate in two directions.

This is not necessary with the cutting blade support arrangement according to the invention; displacement of the cutting blade during the clamping procedure is not possible in either axial nor radial direction.

A particular advantage of the arrangement according to the invention is that, in contrast to prior art cutting blade support arrangements, the rear edge of the cutting blade is not needed for locating the cutting blade on the support plate.

Therefore, the cutting blade can be provided with profiled cutting edges at both radial ends so that the cutting blade can be turned around when the first cutting edge becomes dull. In this way, assuming a given number of possibile grindings for the cutting edge, the cutting blade has twice the useful life of prior art arrangements.

If the cutting blade is provided not only with one pair of bores but with a number of pairs of bore which are radially displaced with respect to the cutting head, the cutting blade can be reset relative to the support plate and the cutting edge of the cutting blade can be further ground. In prior art arrangements, the support plate also had to be ground down if the cutting blade had to be ground beyond the support plate edge which often resulted in breakups at the cutting edge because the grinding wheel pores were being clogged by the ductile material cut from the steel support plate.

An exemplary embodiment of the invention will subsequently be described on the basis of the enclosed drawings.

DESCRIPTION OF A PREFERRED EMBODIMENT

Figure 1:
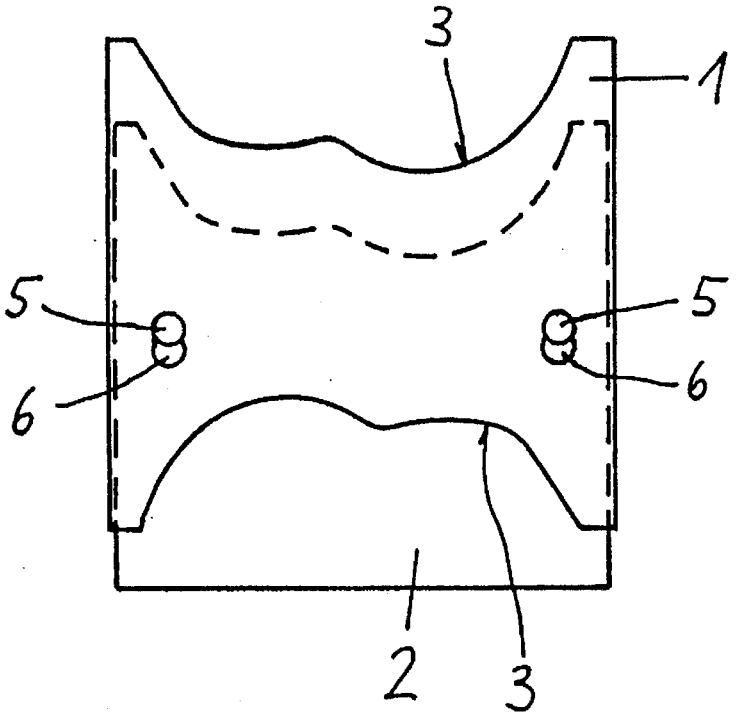
FIG. 1 is a front view of the cutting blade support arrangement according to the invention.
Figure 2:
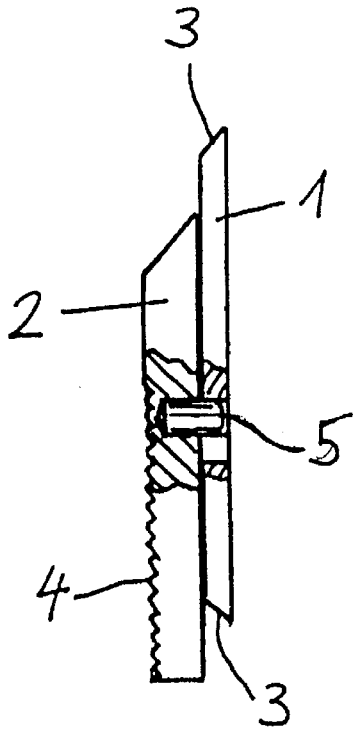
FIG. 2 is a side view of the arrangement shown in FIG. 2.

FIG. 1 shows a cutting blade 1 which is fixed on a support plate 2 which is shown partially covered by the cutting blade 1. FIG. 2 is a side view of the arrangement as shown in FIG. 1 as seen in FIG. 2 from the right side.

As can be seen from FIGS. 1 and 2, the cutting blade is provided at both its upper and its lower edge with the same cutting edge ground profile 3 for cutting a corresponding profile. The cutting blade accordingly has two opposite cutting edges and can be used for cutting with either of the cutting edges by turning it over by 180°.

The support plate is provided, at its rear side, with teeth 4 which, in a known manner, are in engagement with a corresponding tooth structure in the recesses formed in the cutting head and which provide a firm interlock, therewith to prevent radial sliding of the support plate under the centrifugal forces.

The axial as well as radial (with respect to the cutting head axis) firm interconnection between the cutting blade 1 and the support plate 2 is obtained merely by the two fitting pins 5 which are hardened and preferably accurately ground cylindrical pins. The fitting pins 5 are received in corresponding precision bores in the support plate 2 so as to be firmly engaged therein by interference fit. The two fitting pins 5 are arranged on the support plate 2 along a line which extends parallel to the tooth structure 4 on the backside of the support plate 2 with equal distances from the side edges of the support plate, but it is also possible to arrange them in radial direction (with respect to the cutting head in a stepped fashion. It is important however that the arrangement is done in symmetry so that, after wear of one of the cutting edges 3, the cutting blade 1 can be turned around by 180° and can continue to be used with the other cutting edge 3. It is noted however that also other arrangements for the fitting pins 5 may be provided. It is also possible, of course, to provide cutting blades with only one cutting edge for example if an error-free positioning is to be guaranteed.

The cutting blade 1 is provided with accurately ground bores 6 for receiving the fitting pins 5 so that, with the fitting pins 5, a highly accurate fitting with a positioning accuracy in the one hundredth of a millimeter range is achieved.

In order to be able to reset the cutting blade 1 after wear of a cutting edge so as to permit further grinding of the cutting edge, preferably several pairs of bores 6 are provided which may be arranged distinctly separated from one another or which, as shown in FIG. 1, are arranged in an overlapping fashion.

Figure 3:
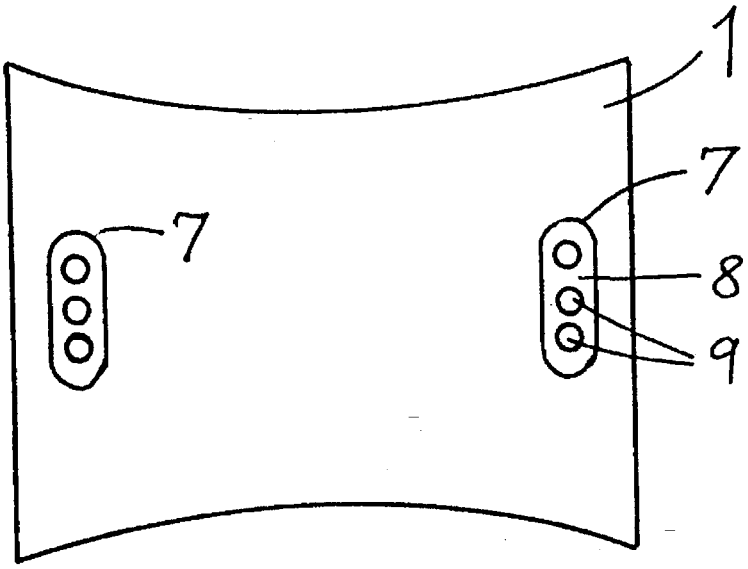
FIG. 3 shows a cutting blade with a number of radially spaced pairs of support bores.

FIG. 3 shows a hardened metal cutting blade 1 with openings 7 formed therein which are substantially larger than the bores needed for the engagement of the blade. The openings 7 are then filled with a relatively soft material 8 into which precision bores 9 can be drilled.

Such relatively soft material can be a metal but resins have been found to be suitable and easy to work with. Since a resin is relatively soft, the bores 9 can be drilled to very small tolerances so that the blade can be positioned in the cutting head highly accurately. Upon clamping of the blade, no forces act upon the relatively soft resin as the blade is directly engaged by the cutting head clamping means.

What is claimed is:

1. A cutting blade mounting arrangement for inserted blade cutting heads comprising a mounting plate for supporting said cutting blade at one side thereof, said mounting plate having on its opposite side a tooth structure for firm engagement with a corresponding tooth structure in the cutting head, said mounting plate having cylindrical fitting pins projecting from said one side thereof and said cutting blade having corresponding ground bores receiving said cylindrical fitting pins for accurately positioning said cutting blade on said support plate in axial as well as in radial direction with respect to the axis of said cutting head.

2. A cutting blade mounting arrangement according to claim 1, wherein said cutting blade includes at least two pairs of ground bores which are, with respect to the axis of the cutting head, radially displaced from one another.

3. A cutting blade mounting arrangement according to claim 2, wherein said pairs of bores in said cutting blades are displaced from one another by less than the diameter of said bores so that the adjacent bores overlap one another.

4. A cutting blade mounting arrangement according to claim 1, wherein said fitting pins are arranged on said mounting plate on a line extending parallel to the tooth structure on the opposite side of said mounting plate.

5. A cutting blade mounting arrangement, according to claim 1 wherein said cutting blade has cutting edges ground thereon at its opposite radial edges and said bores are arranged in the radial center thereof so as to permit utilization of both cutting edges.

6. A cutting blade mounting arrangement for inserted blade cutting heads comprising a mounting surface for supporting a cutting blade at one side thereof, said mounting surface having cylindrical fitting pins projecting therefrom and said cutting blade having openings which are filled with a material softer than the material of which said cutting blades are made and precision bores formed in said softer material for receiving said fitting pins for accurately positioning said cutting blade on said mounting surface.

7. A cutting blade mounting arrangement according to claim 6, wherein said softer material is a resin.

8. A cutting blade mounting arrangement according to claim 6, wherein at least two pairs of bores are formed in said softer material which are radially displaced with respect to the axis of the cutting head.

9. A cutting blade mounting arrangement according to claim 8, wherein said pairs of bores are displaced from one another by less than the diameter of said bores so that adjacent bores overlap one another.

10. A cutting blade mounting arrangement according to claim 6, wherein said mounting surface is one side of a mounting plate having on its opposite side a tooth structure for engagement with a corresponding tooth structure on said cutting head.

* * * * *